United States Patent [19]

Fukui

[11] 4,295,291

[45] Oct. 20, 1981

[54] TOY FIGURE HAVING REPOSITIONABLE HEAD AND LIMBS

[75] Inventor: Osamu Fukui, Tokyo, Japan

[73] Assignee: Takara Co., Ltd., Tokyo, Japan

[21] Appl. No.: 90,414

[22] Filed: Nov. 1, 1979

[30] Foreign Application Priority Data

May 1, 1979 [JP] Japan ..... 54-58486[U]

[51] Int. Cl.[3] ..... A63H 3/20

[52] U.S. Cl. ..... 46/161; 46/173

[58] Field of Search ..... 46/161, 22, 162, 163, 46/151, 173

[56] References Cited

U.S. PATENT DOCUMENTS

| | | | |
|---|---|---|---|
| 725,594 | 4/1903 | Schoenhut | 46/161 |
| 957,666 | 5/1910 | Ferguson | 46/161 |
| 2,618,896 | 11/1952 | Herzog | 46/161 |
| 3,050,900 | 8/1962 | Glass et al. | 46/22 |
| 3,995,395 | 12/1976 | Rahmstorf | 46/22 X |

FOREIGN PATENT DOCUMENTS

| | | | |
|---|---|---|---|
| 1550826 | 8/1979 | United Kingdom | 46/161 |

*Primary Examiner*—Gene Mancene
*Assistant Examiner*—Mickey Yu
*Attorney, Agent, or Firm*—Jackson, Jones & Price

[57] ABSTRACT

A toy figure configured in the shape of a toy doll, or toy animal or the like is disclosed. The toy figure includes a trunk portion having a substantially hollow interior and a head and limb portions. The trunk portion has a plurality of groups of slots, with each group of slots having individual slots in communication with one another. A plurality of deformable elastic members, preferably rubber cords, are attached to the interior of the trunk. Each deformable elastic member is led through one slot of at least one group of slots. The head and each limb is attached to one of the elastic members which are under sufficient tension to hold a substantially flat mating surface of each limb in contact with the trunk. The head and each of the limbs may be repositioned relative to the trunk by moving the corresponding elastic member from one slot to another within the same group of slots.

4 Claims, 5 Drawing Figures

TOY FIGURE HAVING REPOSITIONABLE HEAD AND LIMBS

BACKGROUND OF THE INVENTION

1. Field of the Invention

The present invention is directed to a toy figure configured to simulate a human being or an animal, and particularly to a toy figure having articulated head and limb portions which are positionable at the option of a player in a plurality of different positions relative to a trunk of the toy figure.

2. Brief Description of the Prior Art

Toy dolls and toy figures configured in the shape of various animals have been known for a very long time in the toy manufacturing arts. Toy dolls and toy figures having articulated head and limb members have also been known for a long time.

In several toy dolls of the prior art, the head and the limbs of the toy doll are attached to a main body or trunk portion by rubber bands, rubber cords and like elastic members. U.S. Pat. Nos. 2,611,998 and 2,966,762 describe such toy dolls. In these toys a cavity or cup is provided to receive and frictionally engage a respective male member or stud which is located on the respective head and limb portions of the toy. The rubber bands or cords are disposed within the trunk portion and are under sufficient tension to hold the attached head and limb members in engagement with the respective cavities or cups.

The above described structures permit at least a limiting pivoting movement of the head and limb members relative to the main body or trunk portion. Nevertheless, they do not permit a significant repositioning of the head and limb members relative to the trunk. More explicitly stated, these structures do not permit a temporary removal of either the head or the limb members from engagement with the trunk and a subsequent repositioning of the head or limb members in a configuration wherein they are in contact with a different portion of the outer surface of the trunk or main body portion.

U.S. Pat. No. 3,577,673 describes a toy comprising a plurality of block elements which may be arranged in a plurality of angular configurations. The block elements are provided with a plurality of slots on their several exterior surfaces and are attached to one another by a deformable elastic member such as a rubber cord. The elastic member is led or pulled through cavities or holes which are formed to penetrate through the entire body of the block elements and which are in communication with the slots. Each block element may be brought into contact with one of several exterior surfaces of another block element by placing the connecting elastic member in a different slot.

The toy manufacturing arts are constantly striving to create novel toys which appeal to the imagination and enhance the manual dexterity of the children playing with the toys. Therefore, there is a need in the prior art for a toy figure or doll having head and limb members which may be placed in a plurality of positions in contact with different portions of the outer surface of the trunk or main body member. Such a desirable arrangement allows a large freedom of movement of the head and limb members relative to the trunk, and is provided in the toy figure of the present invention.

SUMMARY OF THE INVENTION

It is an object of the present invention to provide a toy figure or toy doll which has its head and limb portions attached to a main body or trunk portion by a plurality of elastic members.

It is another object of the present invention to provide a toy figure or toy doll wherein a plurality of limb portions may be moved relative to the trunk portion with a relatively large degree of freedom of movement.

It is still another object of the present invention to provide a toy figure or toy doll wherein a head and a plurality of limb portions may be placed in a plurality of predetermined positions relative to a trunk portion, in each position the respective head and limb members being in contact with a different portion of the exterior surface of the trunk portion.

These and other objects and advantages are attained by a toy figure, preferably being in the shape of a humanoid toy doll, which has a trunk portion, a head and a plurality of limb members. The limb members are provided with a mating surface in areas wherein they are in contact with the trunk portion.

The trunk portion is provided with at least a pair of mating surfaces for each of the limb members. The mating surfaces of the trunk portion are adapted to interface with the mating surface of the corresponding limb portion.

Each mating surface of the trunk portion has a slot, and the two slots in each pair of mating surfaces are in communication with one another. The head and the limb portions are attached to the trunk portion by a plurality of deformable elastic member which preferably comprise rubber cords or rubber bands. One of the elastic members is disposed in one of the slots of each pair of slots. The elastic members are adapted for fixedly holding the respective limb members in position with their respective mating surfaces engaging one of the mating surfaces of the mating surface pairs provided on the trunk portion. The elasticity of the elastic members also permits repositioning of the respective limb portions from contact with one of mating surface of a given surface pair to another mating surface of the same pair, while the elastic member is moved from one corresponding slot to another.

The objects and features of the present invention are set forth in the appended claims. The present invention may be best understood by reference to the following description, taken in connection with the accompanying drawings in which like numerals indicate like parts.

DESCRIPTION OF THE PREFERRED EMODIMENT

The following specification taken in conjunction with the drawings sets forth the preferred embodiment of the present invention in such a manner that any person skilled in the toy manufacturing arts can practice the invention. The embodiment of the invention disclosed herein is the best mode contemplated by the inventor for carrying out his invention in a commercial environment, although it should be understood that various modifications can be accomplished within the parameters of the present invention.

Figure 1:
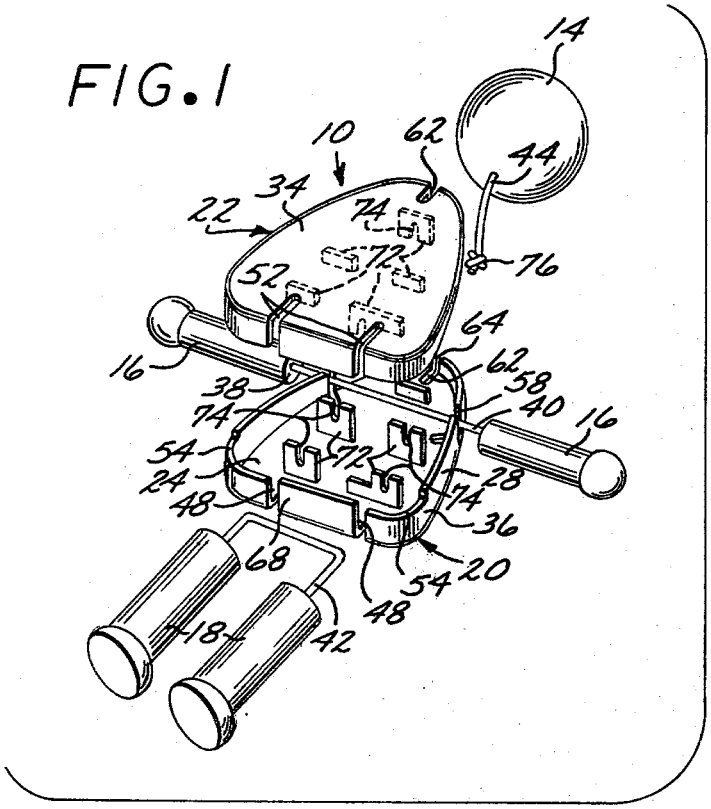
FIG. 1 is an exploded perspective view of a specific embodiment of the toy doll of the present invention.

Referring now to the drawing figures, and more particularly to the exploded perspective view of FIG. 1, a specific embodiment of the toy doll 10 of the present invention is disclosed. It should be noted at the outset that although the ensuing description is specifically directed to the toy doll 10 which is configured in the shape of a humanoid figure, a toy figure simulating the shape of an animal (not shown) may also be constructed in accordance with the present invention.

The toy doll 10 includes a trunk 12, a head 14, a pair of arms 16, and a pair of legs 18. In the specific embodiment described here the trunk 12 is constructed from a front half shell or front portion 20 and rear half shell of rear portion 22. The assembled front and rear half shells 20 and 22 which are complementary to one another together form the substantially hollow shell like trunk 12.

The front and rear half shells 20 and 22 are readily manufactured from relatively inexpensive plastic materials by a molding or like process, although other materials such as wood also readily lend themselves for the manufacture of the herein described toy doll 10. The front and rear half shells 20 and 22 are readily fastened to one another by conventional means; e.g. screws (not shown) may be used. When the half shells 20 and 22 are made of plastic a suitable solvent cement or glue may be used. As it will become apparent from the ensuing description, the assembly of the toy doll is readily accomplished in a few simple steps.

Figure 2:
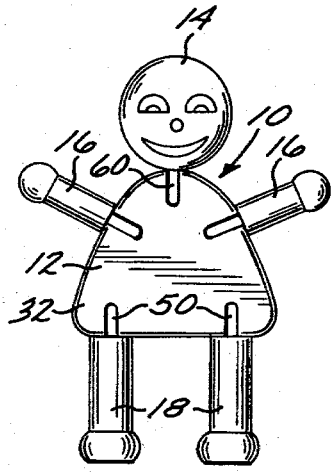
FIG. 2 is a front view of the specific embodiment of the toy doll of the present invention.
Figure 4:
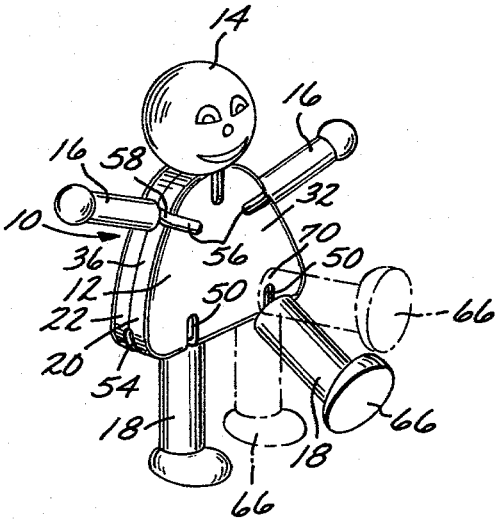
FIG. 4 is a perspective view of the specific embodiment of the toy doll of the present invention, the view showing several positions of a leg member in dotted lines.

Still referring principally to FIG. 1, it is shown that each half shell 20 and 22 of the trunk 12 includes a substantially flat panel and a rim or flange which surrounds the flat panel. The flat panels of front and rear half shells 20 and 22 respectively bear the reference numerals 24 and 26 and the corresponding rims or flanges are respectively numbered 28 and 30. The rims 28 and 30 are disposed substantially perpendicularly to the respective flat panels 24 and 26. It is readily apparent from an inspection of the drawing figures and particularly from FIG. 1 that the assembled trunk 12 has three major surfaces, a frontal surface 32, a rear surface 34 and a peripheral surface 36. The frontal surface 32 is best shown on FIGS. 2 and 4. The frontal surface 32, the rear surface 34 and the peripheral surface 36 respectively correspond to the front, back and side of the body of the toy doll 10.

The arms 16 and the legs 18, which hereinafter when appropriate are collectively referred to as limbs and the head 14 need not be of any particular overall shape. Nevertheless, the use of simple, substantially cylindrically shaped arms 16 and legs 18, as are shown in the appended drawings, is preferred in the specific embodiment of the toy doll 10 of the present invention. In other embodiments, however, a more stylized head, legs and arms may be provided, and the legs and arms may even include knee and elbow joints.

Figure 5:
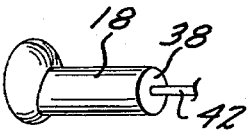
FIG. 5 is a perspective view of a leg of the specific emodiment of the toy doll of the present invention.

Each of the limbs has at one end thereof which is attached to the trunk 12 a surface designed to interface with a matching surface of the trunk 12. The surfaces on the limbs and the matching surfaces on the trunk 12 are referred to as mating surfaces. A substantially flat mating surface 38 provided on one of the legs 18 is shown on FIG. 5, while another substantially flat mating surface 38 provided on one of the arms is shown on FIG. 1.

The limbs as well as the head 14 are attached to the trunk 12 by a plurality of elastic members, which in the herein specific embodiment comprise rubber cords. In alternative embodiments rubber bands or springs may be used instead of the rubber cords. Advantageously, as is shown on FIG. 1, a single rubber cord 40 is fastened to both arms 16, and another single rubber cord 42 is fastened to both legs 18. A third rubber cord 44 is used for attaching the head 14 to the trunk 12. In the assembled toy doll 10, the rubber cords 40, 42 and 44 are under sufficient tension to pull the limbs and the head 14 into contact with the trunk 12 as is shown on FIGS. 2, 3 and 4.

In order to accommodate the rubber cords 40, 42 and 44 and to allow a player (not shown) to optionally move the limbs and the head 14 into several different positions relative to the trunk 12 a plurality of slots or grooves are provided in the trunk 12. More specifically, four slots are provided in the assembled trunk 12 for accommodating each of the legs 18 three for the head 14, and two slots are provided in the trunk 12 for accommodating each of the arms 16.

With reference to any one of the legs 18 it is shown on the figures that a first slot 48 for one leg is disposed on peripheral surface 36 of the trunk, second and third slots 50 and 52 are disposed respectively in the frontal 32 and rear surfaces 34, while a fourth slot 54 for the leg is again disposed in the peripheral surface 36 of the trunk 12.

With reference to either one of the arms 16, it is shown that a first slot 56 is disposed on the frontal surface 32 and a second slot 58 is disposed on the peripheral surface 36. Similarly the slots for the head 14 are respectively disposed in the frontal 32, rear 34 and peripheral 36 surfaces. These slots respectively bear the reference numerals 60, 62 and 64. Each of the slots for any given limb or for the head 14 are in communication with one another so that the corresponding rubber cord may be moved from one slot 46 to another in the assembled toy doll 10. Furthermore, each slot is incorporated in a surface which, except for the peripheral surface in contact with the head 14, has at least a substantially flat portion. In this manner the surfaces containing the slots may respectively mate with the respective substantially flat mating surfaces 38 provided on the limbs.

Thus, a player (not shown) may readily pull any one of the limbs away from contact with the trunk 12, and move the limb into a different position while the corresponding rubber cord is stretched and is placed into a different slot. This is well demonstrated on FIG. 4 with reference to a leg 18. The left leg 66 is shown with dotted lines to occupy a position wherein the mating surface of the leg 66 is in contact with the peripheral surface 36 of the trunk 12. Another position of the left leg 66 wherein it is in contact with the frontal surface 32 of the trunk 12 is also shown with dotted lines. An intermediate position of the left leg 66 is shown with solid lines. It is readily apparent that the intermediate position of the left leg 66 is not stable and that release of a slight pulling force in this position would cause the left leg 66 to swing under tension of the rubber cord 40 to either one of its stable positions indicated by the dotted lines. When the slight pulling force which stretches the rubber cord 42 is released in any of the indicated stable positions of the leg 66, the rubber cord 42 securely pulls the leg 66 into contact with the trunk 12. In effect the toy doll 10 has been reconfigured by the player (not shown).

In light of the above description and in view of the drawing figures, several possible stable positions of the limbs and of the head 14 are readily apparent and need not be further described here. All of these stable positions are of course, readily selected by the player (not shown). Surfaces mating with the substantially flat mating surface 38 of the left leg 66 are indicated for illustration's sake by reference numerals 68 and 70 on FIGS. 1 and 4. It should be noted that instead of having a flat mating surface 38, the limbs may have a slightly convex mating surface. In this case corresponding matching mating surfaces on the trunk 12 are slightly concave. These may be provided in the form of a slight indentation. Flat mating surfaces however serve the purpose of the present invention very well and contribute to a low overall manufacturing cost.

Referring again to FIG. 1, positioning of the rubber cords 40, 42 and 44 in the trunk 12 is disclosed. The front and rear half shells 20 and 22 incorporate a plurality of inwardly projecting ribs 72 with each rib 72 of the frontal half shell 20 interfacing with another rib 72 of the rear half shell 22. Grooves 74 provided in the ribs 72 accommodate the ruber cords 40, 42 and 44 as is shown on FIG. 1. A knot 76 or the like is provided on the rubber cord 44 attaching the head 14, so that an end of the rubber cord 46 bearing the knot 76 cannot slip through the groove 74.

Figure 3:
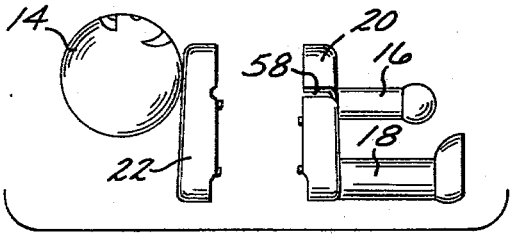
FIG. 3 is a partially exploded side view showing the assembly of the specific emodiment of the toy doll of the present invention.

Referring now to FIG. 3, assembly of the toy doll 10 of the present invention is disclosed. The arms 16 and the legs 18 are placed through the respective rubber cords 40 and 42 in the corresponding grooves 74 of the ribs 72 in the front half shall 20 preferably so that the arms and the legs occupy a position perpendicular to the frontal surface 32. In this position, shown on FIG. 3, the arms 16 and the legs 18 are substantially stable even prior to joining the two half shells 20 and 22 to one another. The rubber cord 44 for the head 14 is then placed in the groove 74 provided in one of the ribs 72 of the rear half shell 22 and the head 14 is placed behind the rear surface 34. The front and rear half shells 20 and 22 are then attached to one another by screws, solvent cementing or the like as it was briefly described. Subsequently the head 14 and the limbs may be moved into any of the above described desired positions.

What has been described above is a toy doll or toy figure having a head and limb attached to a trunk portion by a plurality of elastic members. The head and the limbs are movable relative to the trunk into a plurality of desired positions with a relatively large degree of freedom of movement.

Several modifications of the above described toy may become readily apparent to those skilled in the art in light of the above teachings. Therefore, the scope of the present invention should be interpreted solely from the following claims.

What is claimed is:

1. A toy doll figure comprising:

a plurality of limb members configured to simulate limb members such as arms and legs of a humanoid;

a head member configured to simulate a humanoid head;

an approximately triangularly-shaped hollow body member having a front portion and a rear portion, each portion having a substantially flat panel respectively corresponding to the front and the back of the toy doll figure and a peripheral rim disposed substantially at a right angle to the flat panels, the body member being assembled from the front and rear portions so that the rims are in contact with one another, the rims having apertures approximately aligned with the respective positions of the limb members and head members and one or more of the front portions and rear portions having an aligned aperture with a rim aperture extending across its flat panel to form a continous slot that extends across the right angled interface of the flat panels and the rim, each limb member having a substantially flat mating surface with a substantially circular periphery to permit a juxtapositional mounting of the respective limb members flush against the body member; the rim aperture for the arm limb members positioned to enable the arms to extend vertically upward relative to a horizontal support surface;

resilient connectors are fixedly attached to each limb member and head member and are attached within the hollow body member to permit limited relative movement between the body member and each limb member and the head member;

at least a pair of rib members are mounted respectively on the front portion and the rear portion within the hollow body member to secure at least one resilient connector, the respective rib members extend upward from the interior of the flat panel members respectively and are spaced apart from the peripheral rim, one of the respective rib members is configured with a groove to receive a portion of the resilient connector while the other rib member is configured with a flat surface to hold the resilient connector within the groove whereby the head member and the limb member may be selectively placed in at least two positions at the option of a player.

2. The invention of claim 1 wherein the resilient connectors fixedly attached to each limb member comprises a single elastic member that is interconnected between two of the limb members.

3. The invention of claim 1 wherein a plurality of ribs are attached to the front portion and the rear portion of the body member, the ribs project inwardly into the interior of the body member, and the ribs are provided with means for fixedly positioning the resilient connectors to the body member.

4. The invention of wherein the resilient connectors are rubber cords.

* * * * *